US009094764B2

(12) United States Patent
Rosener

(10) Patent No.: US 9,094,764 B2
(45) Date of Patent: Jul. 28, 2015

(54) VOICE ACTIVITY DETECTION WITH CAPACITIVE TOUCH SENSE

(75) Inventor: Douglas Rosener, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 1224 days.

(21) Appl. No.: 12/061,617

(22) Filed: Apr. 2, 2008

(65) Prior Publication Data

US 2009/0252351 A1 Oct. 8, 2009

(51) Int. Cl.
*H04R 25/00* (2006.01)
*H04R 19/00* (2006.01)

(52) U.S. Cl.
CPC ..... *H04R 19/00* (2013.01); *H04R 2460/13* (2013.01)

(58) Field of Classification Search
CPC ..... H04R 2460/13
USPC ..... 381/151, 380, 384; 455/550.1
See application file for complete search history.

(56) References Cited

U.S. PATENT DOCUMENTS

| | | | | |
|---|---|---|---|---|
| 3,109,893 | A | 11/1963 | Burns | |
| 3,383,466 | A | 5/1968 | Hillix et al. | |
| 4,330,690 | A | 5/1982 | Botros | |
| 4,591,668 | A | 5/1986 | Iwata | |
| 4,901,354 | A | 2/1990 | Gollmar et al. | |
| 5,590,241 | A | 12/1996 | Park et al. | |
| 5,692,059 | A | 11/1997 | Kruger | |
| 5,933,506 | A | 8/1999 | Aoki et al. | |
| 6,442,013 | B1 * | 8/2002 | Lindgren et al. | 361/280 |
| 6,484,027 | B1 * | 11/2002 | Mauney et al. | 455/421 |
| 6,532,447 | B1 * | 3/2003 | Christensson | 704/275 |
| 2001/0044318 | A1 * | 11/2001 | Mantyjarvi et al. | 455/550 |
| 2002/0068537 | A1 | 6/2002 | Shim et al. | |
| 2003/0059078 | A1 * | 3/2003 | Downs et al. | 381/381 |
| 2004/0105538 | A1 | 6/2004 | Goebel | |
| 2004/0133421 | A1 | 7/2004 | Burnett | |
| 2005/0221791 | A1 | 10/2005 | Angelhag | |
| 2006/0029234 | A1 * | 2/2006 | Sargaison | 381/74 |
| 2007/0076897 | A1 | 4/2007 | Philipp | |
| 2007/0121959 | A1 | 5/2007 | Philipp | |

FOREIGN PATENT DOCUMENTS

| | | | |
|---|---|---|---|
| EP | 0564164 | A1 | 10/1993 |
| EP | 0637187 | A1 | 2/1995 |
| GB | 2357400 | A | 6/2001 |
| WO | 00/76177 | A1 | 12/2000 |
| WO | 01/63888 | A1 | 8/2001 |

OTHER PUBLICATIONS

Philipp, Harald, "Headset Power Management", U.S. Appl. No. 60/722,476, filed Sep. 30, 2005.

* cited by examiner

*Primary Examiner* — Shaun Campbell
*Assistant Examiner* — Raj R Gupta
(74) *Attorney, Agent, or Firm* — Chuang Intellectual Property Law

(57) ABSTRACT

A voice activity detection apparatus having a capacitive sensor and a voice activity detector sensor. The voice activity detector sensor detects vibration of human tissue associated with user speech. Utilization of the voice activity detector sensor output is tied to the output of the capacitive sensor, where the capacitive sensor detects whether it is in contact with user skin.

16 Claims, 11 Drawing Sheets

600

| 610 State | Presence or Absence of Signal: Capacitive Sensor 10 | Presence or Absence of Signal: VAD Sensor 12 | VAD Processor Output 612 |
|---|---|---|---|
| 1 | 1 | 1 | Talk State (Voice Activity) |
| 2 | 1 | 0 | Listen State (No Voice Activity) |
| 3 | 0 | 1 | Indeterminate |
| 4 | 0 | 0 | Indeterminate |

1 = Signal Present

0 = No Signal Present

FIG. 6

700

| 710 State | Presence or Absence of Signal: Capacitive Sensor 210 | Capacitive Sensor 214 | VAD Sensor 212 | VAD Processor Output 712 |
|---|---|---|---|---|
| 1 | 1 | 1 | 1 | Talk State (Voice Activity) |
| 2 | 1 | 1 | 0 | Listen State (No Voice Activity) |
| 3 | 0 | 1 | 1 | Indeterminate |
| 4 | 0 | 1 | 0 | Indeterminate |
| 5 | 1 | 0 | 1 | Indeterminate |
| 6 | 1 | 0 | 0 | Indeterminate |
| 7 | 0 | 0 | 1 | Indeterminate |
| 8 | 0 | 0 | 0 | Indeterminate |

1 = Signal Present

0 = No Signal Present

FIG. 7

VOICE ACTIVITY DETECTION WITH CAPACITIVE TOUCH SENSE

BACKGROUND OF THE INVENTION

Voice activity detectors (VAD) are used in microphone applications to monitor input and determine when intended speech is or is not occurring. The VAD determination of voice or no voice may be used in digital signal processing (DSP) voice processing algorithms which adapt filters to noise for transmit signal (Tx) noise reduction. The VAD allows the voice processing algorithms to adapt the noise filters only when speech is not present.

In the prior art, typical VADs detect speech by analyzing the input signal received at the microphone. For example, the signal level of the input signal may be measured and compared to a pre-determined threshold level above which speech is determined to be occurring and below which speech is determined not to be occurring.

Voice activity detectors known in the prior art may also detect speech using an external sensor (also referred to herein as a VAD sensor) such as an accelerometer in contact with a wearer's head. The VAD sensor, using appropriate software and hardware, indicates when speech is occurring based on detection of tissue vibration associated with human speech by the wearer. However, one problem with the prior art VAD sensors is that they must be in complete contact with the user head in order to function. If complete contact is not present, the VAD sensor does not function properly. As a result, any application relying on the VAD sensor determination does not function properly. For example, the aforementioned DSP noise filtering algorithm does not perform as desired when the voice activity detection determination is inaccurate.

Prior art VAD sensors typically use some form of a mechanical means to ensure that the sensor is in contact with the user skin. However, neither the user nor any subsequent processing algorithm is provided any feedback whether the VAD sensor is properly positioned. In a noise reduction application, the Tx noise reduction will not function if the user that does not position the VAD sensor correctly. In some cases, improper positioning of the VAD may prevent the Tx operation from functioning completely.

As a result, there is a need for improved methods and apparatuses for improved voice activity detection.

BRIEF DESCRIPTION OF THE DRAWINGS

The present invention will be readily understood by the following detailed description in conjunction with the accompanying drawings, wherein like reference numerals designate like structural elements.

FIG. 6 is a table illustrating operation of the voice activity detection apparatus shown in FIG. 4.

FIG. 7 is a table illustrating operation of the voice activity detection apparatus shown in FIG. 5.

DESCRIPTION OF SPECIFIC EMBODIMENTS

Figure 1:
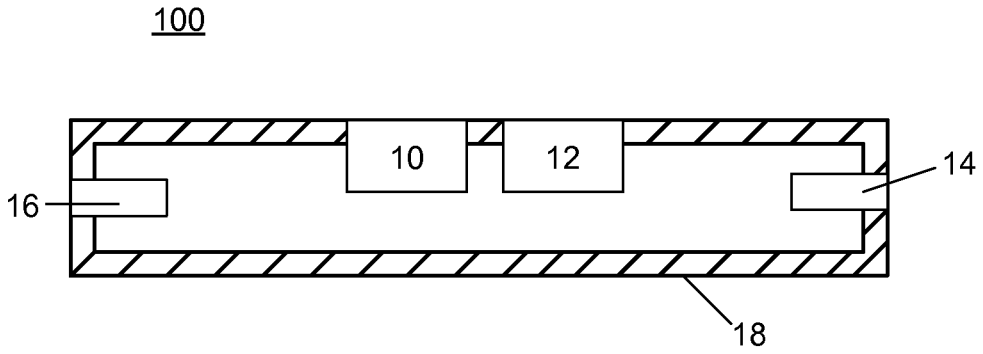
FIG. 1 is a sectional view illustrating a configuration of a voice activity detection apparatus in a first example of the invention.

Methods and apparatuses for voice activity detection are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

This invention relates generally to the field of electronic devices with voice activity detectors. In one example, the methods and systems described herein utilize a capacitive sensor to determine whether a VAD sensor is in contact with a wearer's head. The capacitive sensor and the VAD sensor are physically arranged so that if the VAD sensor is in the right position, both sensors are touching the head. The sensitivity of the capacitive sensor is adjusted so that it will indicate "touch" only when touching the head.

In a telecommunications headset example application, the headset constantly monitors the capacitive sensor. When the capacitive sensor is in contact with the head, it will indicate that both the headset is being worn and that the VAD sensor is in the proper position to be used. The capacitive sensor may also enhance the probability that the microphone position is correct. In one example, the capacitive sensor is placed in close proximity to the VAD sensor.

In a further telecommunications headset example application, the headset includes a first capacitive sensor in close proximity to the headset receiver near the wearer's ear. This capacitive sensor ensures proper positioning of the receiver when the headset is worn and may be used for determining whether the headset is in a worn state (donned) or not worn state (doffed). An additional second capacitive sensor is placed in close proximity to the VAD sensor to properly position the microphone. In this manner, the capacitive sensors can be used to determine whether the headset is optimally placed for both transmit and receive operation purposes. The use of the second capacitive sensor in proximity to the VAD sensor improves the reliability of the donned or doffed determination.

In one example, a voice activity detection apparatus includes a capacitive sensor and a voice activity detector sensor. The capacitive sensor provides a capacitive sensor output signal, and detects whether the capacitive sensor is in contact with a user skin. The voice activity detector sensor provides a voice activity detector sensor output signal, and detects vibration of human tissue associated with user speech. The voice activity detection apparatus further includes a processor which receives the capacitive sensor output signal and the voice activity detector sensor output signal. The voice activity detector sensor output signal is processed to determine a voice activity status only if the capacitive sensor output signal indicates that the capacitive sensor is in contact with the user skin.

In one example, a voice activity detection apparatus includes a first capacitive sensor, a second capacitive sensor, and a voice activity detector sensor. The first capacitive sensor provides a first capacitive sensor output signal, where the first capacitive sensor detects whether the first capacitive sensor is in contact with a user skin. The second capacitive sensor provides a second capacitive sensor output signal, where the second capacitive sensor also detects whether the second capacitive sensor is in contact with the user skin. The voice activity detector sensor provides a voice activity detector sensor output signal, where the voice activity detector sensor detects vibration of human tissue associated with user speech. The voice activity detection apparatus further includes a processor which receives the first capacitive sensor output signal, the second capacitive sensor output signal and the voice activity detector sensor output signal. The voice activity detector sensor output signal is processed to determine a voice activity status only if both the first capacitive sensor output signal indicates that the first capacitive sensor is in contact with the user skin and the second capacitive sensor output signal indicates that the second capacitive sensor is in contact with the user skin.

In one example, a voice activity detection method includes providing a capacitive sensor and a voice activity detector sensor. A capacitive sensor output signal is output indicating whether the capacitive sensor is in contact with a user skin. The method includes outputting a voice activity detector sensor output signal, and processing the voice activity detector sensor output signal to determine a voice activity status only if the capacitive sensor output signal indicates that the capacitive sensor is in contact with the user skin.

In one example, a voice activity detection method includes providing a first capacitive sensor, second capacitive sensor, and a voice activity detector sensor. The method includes outputting a first capacitive sensor output signal indicating whether the first capacitive sensor is in contact with a user skin, outputting a second capacitive sensor output signal indicating whether the second capacitive sensor is in contact with a user skin, and outputting a voice activity detector sensor output signal. The method further includes processing the voice activity detector sensor output signal to determine a voice activity status only if both the first capacitive sensor and the second capacitive sensor are in contact with the user skin.

In one example, a voice activity detection apparatus includes a skin contact sensing means, such as a capacitive sensor, for determining contact with a user skin. The voice activity detection apparatus further includes a tissue vibration sensing means, such as an accelerometer, for detecting vibration of human tissue associated with user speech. The voice activity detection apparatus further includes a processing means, such as a microprocessor, for processing an output of the tissue vibration detecting means to determine a voice activity status only if the skin contact sensing means is in contact with the user skin.

FIG. 1 is a sectional view illustrating a configuration of a voice activity detection apparatus 100 in a first example. The voice activity detection apparatus 100 includes a capacitive sensor 10, a voice activity detector sensor 12, a microphone 14, and a receiver 16. The voice activity detection apparatus 100 includes a housing 18 having an exterior surface on which the capacitive sensor 10 and the voice activity detector sensor 12 are disposed adjacent to each other. The shape of housing 18 and placement of capacitive sensor 10 and voice activity detector sensor 12 or other components may be varied depending upon the specific application of voice activity detection apparatus 100. The type and number of capacitive sensors may be varied. The general operation of voice activity detection apparatus 100 is that the output of voice activity detector sensor 12 is utilized or not utilized based on the output of capacitive sensor 10.

The capacitive sensor 10 detects whether it is in contact with a user skin. The voice activity detector sensor 12 detects vibration of human tissue associated with user speech. Such vibrations are easily detected during user speech. In one example, the voice activity detector sensor 12 is any device capable of detecting tissue vibration, including skin vibration and bone vibration, using any means. For example, the voice activity detector sensor 12 may be a bone conduction microphone, an accelerometer, a tissue conduction microphone, or a capacitance sensor. The capacitance sensor detects skin vibration as a variation in capacitance between the skin and an electrode on the headset. The vibrations detected by voice activity detector sensor 12 may be processed at the sensor using to determine the voice activity status, or the voice activity detector sensor 12 may output a signal to be later processed to determine the voice activity status. In one example, microphone 14 is an acoustic microphone that detects acoustic air waves associated with user speech.

Figure 4:
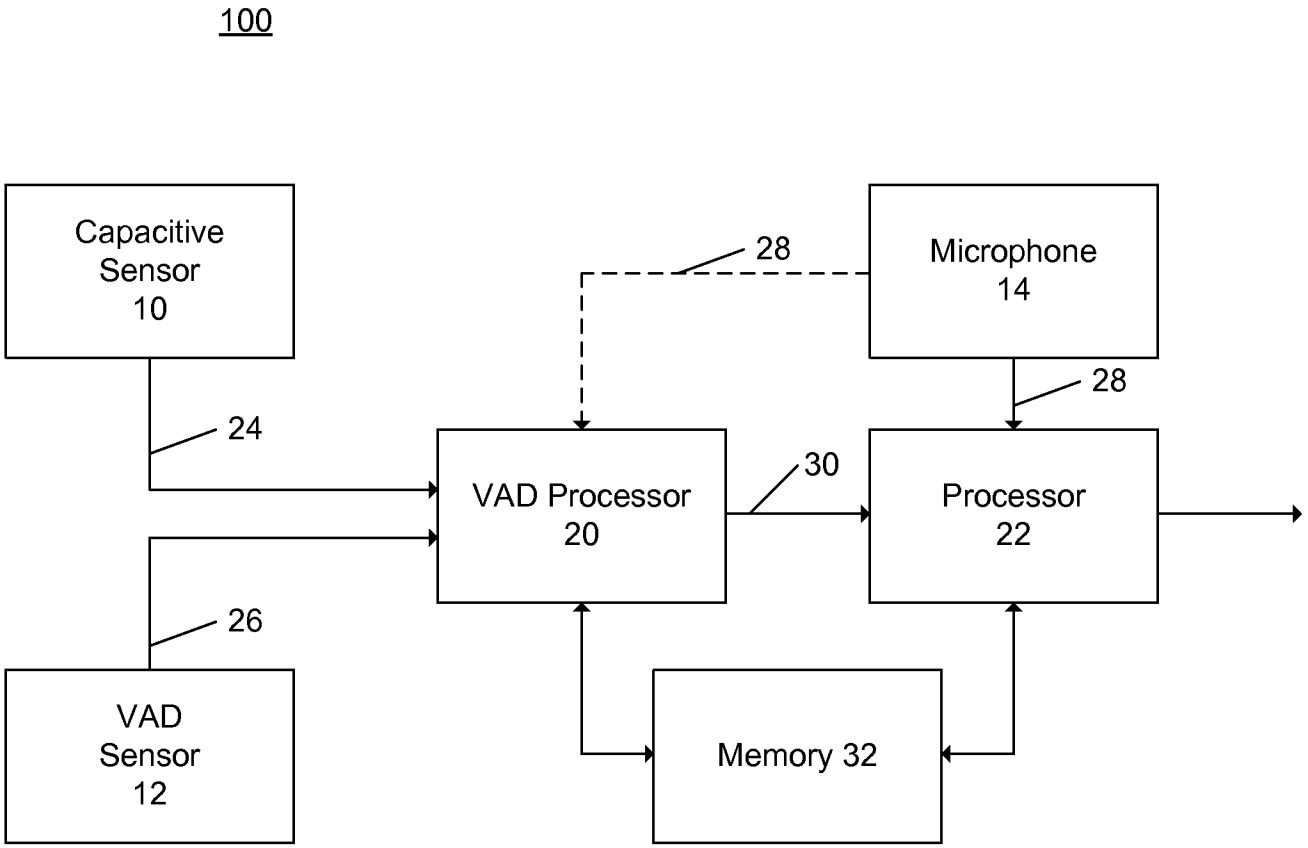
FIG. 4 is a simplified block diagram illustrating a voice activity detection apparatus in an example of the invention.

FIG. 4 is a simplified block diagram illustrating a voice activity detection apparatus 100 shown in FIG. 1 in an example of the invention. Capacitive sensor 10 provides a capacitive sensor output signal 24, and detects whether the capacitive sensor 10 is in contact with a user skin. Capacitive sensor 10 may be a charge transfer sensing capacitance sensor, for example. Capacitive sensor 10 is arranged to output capacitive sensor output signal 24 to VAD processor 20.

Memory 32 stores firmware/software executable by VAD processor 20 and processor 22 to process data received from capacitive sensor 10, VAD sensor 12, and microphone 14. Memory 32 may include a variety of memories, and in one example includes SDRAM, ROM, flash memory, or a combination thereof. Memory 32 may further include separate memory structures or a single integrated memory structure.

VAD processor 20 and processor 22, using executable code and applications stored in memory, performs the necessary functions associated with the voice activity detection apparatus operation described herein. Although illustrated separately, VAD processor 20 and processor 22 may be integrated into a single processor. VAD processor 20 and processor 22 may include a variety of processors (e.g., digital signal processors), with conventional CPUs being applicable.

The VAD sensor 12 provides a VAD sensor output signal 26, and detects vibration of human tissue associated with user speech. The voice activity detection apparatus 100 includes a VAD processor 20 which receives the capacitive sensor output signal 24 and the VAD sensor output signal 26. The VAD sensor output signal 26 is processed by VAD processor 20 to determine a voice activity status only if the capacitive sensor output signal 24 indicates that the capacitive sensor 10 is in contact with the user skin. VAD sensor output signal 26 may either require further processing to determine a voice activity status or may be a binary voice or no voice signal. Where VAD sensor output signal 26 is a binary voice or no voice signal, processing by VAD processor 20 passes the VAD sensor output signal 26 to processor 22. In this manner, the accuracy of VAD sensor output signal 26 as an indicator of voice status or no voice status is increased. VAD processor 20 outputs an output signal 30 to processor 22 indicating voice activity, no voice activity, or an indeterminate status.

In one example, the voice activity detection apparatus 100 includes an acoustic microphone 14 providing an acoustic microphone output signal 28. In one example, the acoustic microphone output signal 28 is processed to determine a voice activity status by VAD processor 20. Alternatively, microphone output signal 28 may be processed to determine a voice activity status by processor 22. In one example, the acoustic microphone output signal 28 is processed to determine a voice activity status only if the capacitive sensor output signal 24 indicates that the capacitive sensor 10 is not in contact with the user skin. In this manner, where VAD sensor 12 is deemed unreliable, the voice activity detection apparatus 100 utilizes microphone output signal 28 to determine voice activity status. For example, the signal level of microphone output signal 28 may be measured and compared to a voice activity threshold level.

Figure 2:
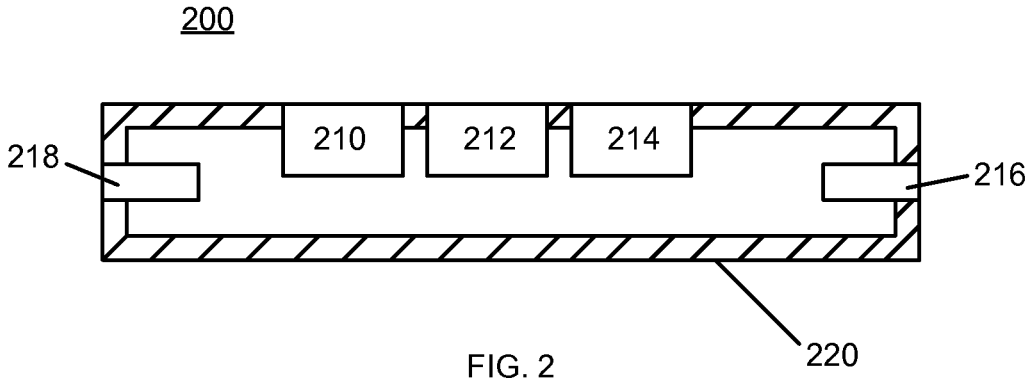
FIG. 2 is a sectional view illustrating a configuration of a voice activity detection apparatus in a second example of the invention.

FIG. 2 is a sectional view illustrating a configuration of a voice activity detection apparatus 200 in a second example of the invention. Voice activity detection apparatus 200 includes a first capacitive sensor 210, a second capacitive sensor 214, and a voice activity detector sensor 212. The first capacitive sensor 210 detects whether the capacitive sensor is in contact with a user skin. The second capacitive sensor 214 also detects whether the capacitive sensor is in contact with the user skin. The voice activity detector sensor 212 detects vibration of human tissue associated with user speech. In one example, the voice activity detection apparatus 200 includes a receiver 218 for outputting an audio signal. In further examples, additional capacitive sensors may be used and placed as needed to confirm VAD sensor 212 is properly positioned.

In one example, the voice activity detector sensor 212 is any device capable of detecting tissue vibration, including bone or skin vibration, using any means. For example, the voice activity detector sensor 212 may be a bone conduction microphone, an accelerometer, a tissue conduction microphone, or a capacitance sensor.

The voice activity detection apparatus 200 includes a housing 220 having an exterior surface on which the first capacitive sensor 210, the second capacitive sensor 214, and the voice activity detector sensor 212 are disposed. In the example shown in FIG. 2, the first capacitive sensor 210 and the second capacitive sensor 214 are disposed on opposite sides of and adjacent to the voice activity detector sensor 212. In this linear arrangement, the reliability of utilizing first capacitive sensor 210 and second capacitive sensor 214 to determine proper placement of voice activity detector sensor 212 is increased. However, in further examples, the placement of first capacitive sensor 210 and second capacitive sensor 214 may be varied.

Figure 5:
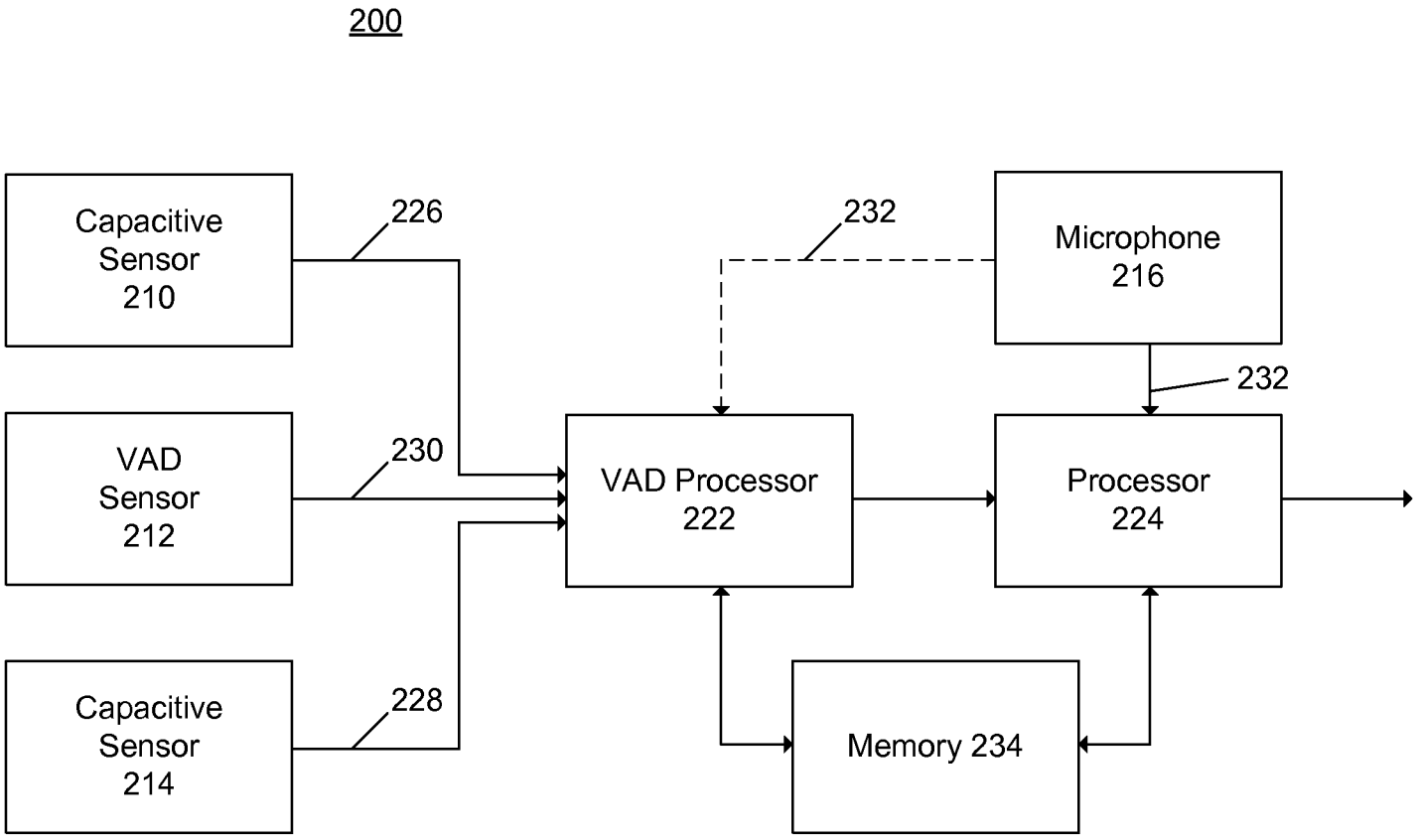
FIG. 5 is a simplified block diagram illustrating a voice activity detection apparatus in a further example of the invention.

FIG. 5 is a simplified block diagram illustrating the voice activity detection apparatus 200 shown in FIG. 2. The voice activity detection apparatus 200 includes a memory 234 storing firmware/software executable by a VAD processor 222 and processor 224 to process data received from capacitive sensor 210, capacitive sensor 214, VAD sensor 12, and microphone 216. VAD processor 222 and processor 224, using executable code and applications stored in memory 234, performs the necessary functions associated with the voice activity detection apparatus operation described herein. The structure of memory 234, VAD processor 222 and processor 224 are the same as described above in reference to FIG. 4.

The first capacitive sensor 210 provides a capacitive sensor output signal 226, where the first capacitive sensor detects contact with a user skin. The second capacitive sensor 214 provides a second capacitive sensor output signal 228, where the second capacitive sensor 214 detects contact with the user skin. The voice activity detector sensor 212 provides a voice activity detector sensor output signal 230, where the voice activity detector sensor 212 detects vibration of human tissue associated with user speech. The voice activity detection apparatus 200 further includes a VAD processor 222 which receives the capacitive sensor output signal 226, the capacitive sensor output signal 228 and the voice activity detector sensor output signal 230. The voice activity detector sensor output signal 230 is processed to determine a voice activity status only if both the capacitive sensor output signal 226 indicates that the first capacitive sensor 210 is in contact with the user skin and the second capacitive sensor output signal 228 indicates that the second capacitive sensor 214 is in contact with the user skin.

In one example, the voice activity detection apparatus 200 includes an acoustic microphone 216 providing an acoustic microphone output signal 232. In one example, the acoustic microphone output signal 232 is processed to determine a voice activity status by VAD processor 222. Alternatively, microphone output signal 232 may be processed to determine a voice activity status by processor 224. In one example, the acoustic microphone output signal 232 is processed to determine a voice activity status only if the capacitive sensor output signal 2226 and capacitive sensor output signal 228 indicate that they are not in contact with the user skin. In this manner, where VAD sensor 212 is considered unreliable because its contact with the user skin cannot be verified, the voice activity detection apparatus 200 utilizes microphone output signal 232 to determine voice activity status. For example, the signal level of microphone output signal.

Figure 3:
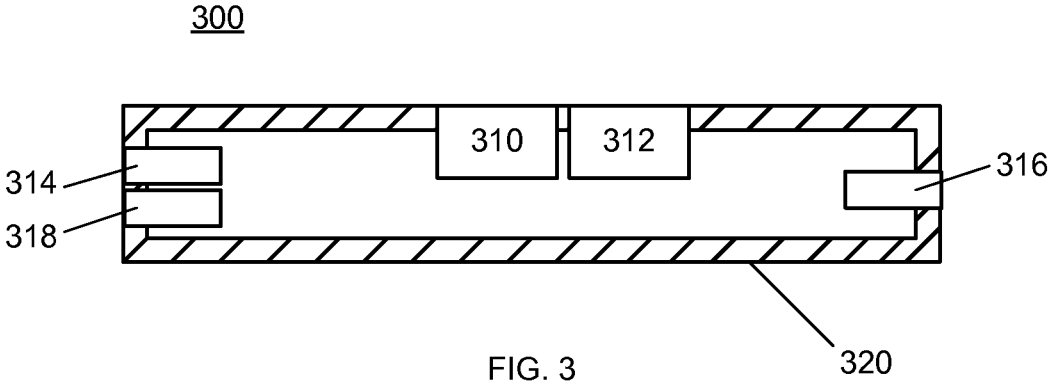
FIG. 3 is a sectional view illustrating a configuration of a voice activity detection apparatus in a third example of the invention.

FIG. 3 is a sectional view illustrating a configuration of a voice activity detection apparatus in a third example of the invention. Voice activity detection apparatus 300 includes a first capacitive sensor 310, a second capacitive sensor 314, and a voice activity detector sensor 312. The first capacitive sensor 310 and second capacitive sensor 314 detect whether each capacitive sensor is in contact with the user skin. The voice activity detector sensor 312 detects vibration of human tissue associated with user speech. In one example, the voice activity detection apparatus 300 includes a receiver 318 for outputting an audio signal.

The voice activity detection apparatus 300 includes a housing 320 having an exterior surface on which the first capacitive sensor 310, the second capacitive sensor 314, and the voice activity detector sensor 312 are disposed. In the example shown in FIG. 3, the second capacitive sensor 314 is located in close proximity to the receiver 318 and the first capacitive sensor 310 is located in close proximity to the voice activity detector sensor 312. The first capacitive sensor 310 is located in close proximity to the voice activity detector sensor 312 to achieve a high correlation between the sensors whether they are both contacting user skin and not contacting user skin. The simplified block diagram of voice activity detection apparatus 300 is substantially similar to the block diagram shown in FIG. 5.

FIG. 6 is a table 600 illustrating operation of the voice activity detection apparatus 100 shown in FIG. 4 in one example. In particular, table 600 illustrates the operating logic of VAD processor 20. A VAD processor output 612 is dependent on a state 610 of capacitive sensor 10 and VAD sensor 12. In states 1 and 2, capacitive sensor 10 outputs a signal indicating contact with a user skin. In states 1 and 2, the output of VAD sensor 12 is considered a valid indicator of whether there is voice activity or no voice activity. Thus, in state 1, where VAD sensor 12 outputs a signal indicating that voice activity has been detected, the VAD processor output 612 is a signal indicating a talk state (i.e., voice activity is present). In state 2, where VAD sensor 12 outputs a signal indicating that voice activity has not been detected, the VAD processor output 612 is a signal indicating a listen state (i.e., no voice activity present).

In states 3 and 4, capacitive sensor 10 outputs a signal indicating no contact with a user skin. In states 3 and 4, the output of VAD sensor 12 is not considered a valid indicator of whether there is voice activity or no voice activity because contact of the VAD sensor 12 with the user skin cannot be verified. In states 3 and 4, the VAD processor output 612 is indeterminate regardless of the VAD sensor 12 output. In states 3 and 4, an alternate voice activity detection method may be used, such as microphone output signal level analysis techniques.

FIG. 7 is a table illustrating operation of the voice activity detection apparatus shown in FIG. 5. In particular, table 700 illustrates the operating logic of VAD processor 222. A VAD processor output 712 is dependent on a state 710 of first capacitive sensor 210, second capacitive sensor 214, and VAD sensor 212. In states 1 and 2, both first capacitive sensor 210 and second capacitive sensor 214 output a signal indicating contact with a user skin. In states 1 and 2, the output of VAD sensor 212 is considered a valid indicator of whether there is voice activity or no voice activity. Thus, in state 1, where VAD sensor 212 outputs a signal indicating that voice activity has been detected, the VAD processor output 712 is a signal indicating a talk state (i.e., voice activity is present). In state 2, where VAD sensor 212 outputs a signal indicating that voice activity has not been detected, the VAD processor output 712 is a signal indicating a listen state (i.e., no voice activity present).

In states 3 through 6, either capacitive sensor 210 or capacitive sensor 214 output a signal indicating no contact with a user skin. In states 3 through 6, the output of VAD sensor 212 is not considered a valid indicator of whether there is voice activity or no voice activity because contact of the VAD sensor 212 with the user skin cannot be verified. In states 3 through 6, the VAD processor output 712 is indeterminate regardless of the VAD sensor 212 output.

In states 7 and 8, both capacitive sensor 210 and capacitive sensor 214 output a signal indicating no contact with a user skin. In states 7 and 8, the output of VAD sensor 212 is not considered a valid indicator of whether there is voice activity or no voice activity because contact of the VAD sensor 212 with the user skin cannot be verified. In states 7 and 8, the VAD processor output 712 is indeterminate regardless of the VAD sensor 212 output. In states 3 through 8, an alternate voice activity detection method may be used as described herein.

The logical operation of the VAD processor may be varied in further examples. For example, the output of VAD sensor 212 may be considered a valid indicator of whether there is voice activity or no voice activity if only capacitive sensor 210 or capacitive sensor 214 indicates contact with user skin. In further examples, more than two capacitive sensors may be used, with the output of VAD sensor 212 considered a valid indicator based on the output of a select capacitive sensor or sensors. Referring again to FIG. 11, an example where more than two capacitive sensors are used is illustrated. The output of a VAD sensor 412 is considered a valid indicator of voice activity or no voice activity based on the output of capacitive sensors 410, 414, and 416. Though the logical operation of the VAD processor may be varied, in one example, all three capacitive sensors 410, 414, and 416 must indicate contact with use skin for the output of VAD sensor 412 to be considered a valid indicator.

Figure 11:
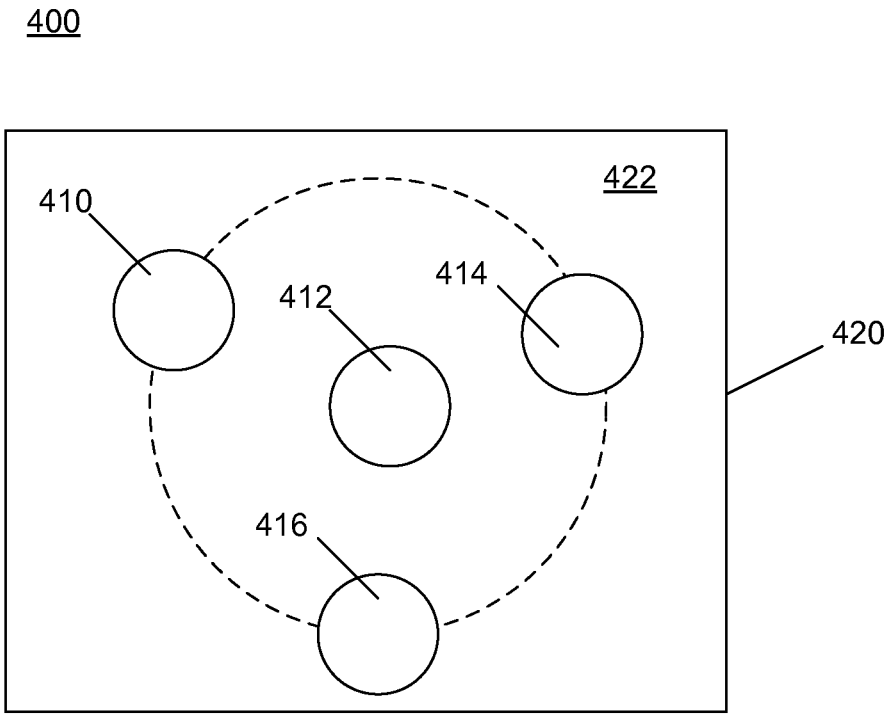
FIG. 11 illustrates a configuration of a voice activity detection apparatus in one example.

FIG. 11 is a top view illustrating a configuration of a voice activity detection apparatus 400 in a second example of the invention. Voice activity detection apparatus 400 includes a plurality of capacitive sensors disposed in an array around a voice activity detector sensor. For example, the capacitive sensors may be disposed in a circular array or a square pattern around the voice activity detector. The number of capacitive sensors and the pattern of the sensors around the voice activity detector may be varied. The voice activity detection apparatus 400 includes a housing 420 having an exterior surface 422 on which the capacitive sensor 410, the capacitive sensor 414, the capacitive sensor 416 and the voice activity detector sensor 412 are disposed. In the example shown in FIG. 11, the voice activity detection apparatus 400 utilizes capacitive sensor 410, capacitive sensor 414, and capacitive sensor 416 disposed in a circular or ring pattern around a voice activity detector sensor 412.

By use of a plurality of capacitive sensors disposed in an array around the voice activity detector sensor, the reliability of utilizing the capacitive sensors to determine proper placement of voice activity detector sensor 412 is increased. Use of a circular or ring pattern is advantageous where space on the headset housing exterior surface is limited. As a further advantage, use of the circular or ring pattern may be rotationally insensitive and may be useful in an adjustable and left-right switchable headset. Capacitive sensors 410, 414 and 416 each detect whether it is in contact with a user skin. The voice activity detector sensor 412 detects vibration of human tissue associated with user speech. In one example, the voice activity detector sensor 412 is any device capable of detecting tissue vibration, including bone or skin vibration, using any means. For example, the voice activity detector sensor 412 may be a bone conduction microphone, an accelerometer, a tissue conduction microphone, or a capacitance sensor.

Figure 8A:
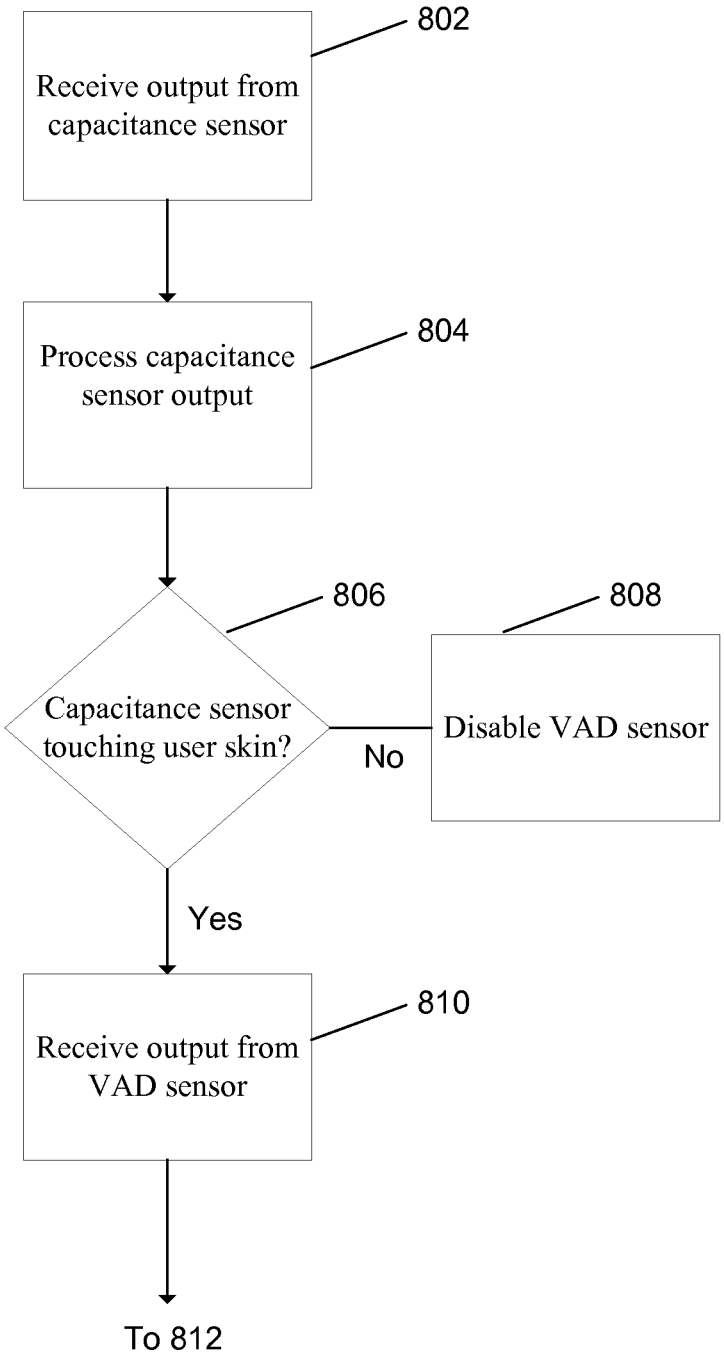
FIGS. 8A and 8B are a flowchart illustrating a voice activity detection process in an example.
Figure 8B:
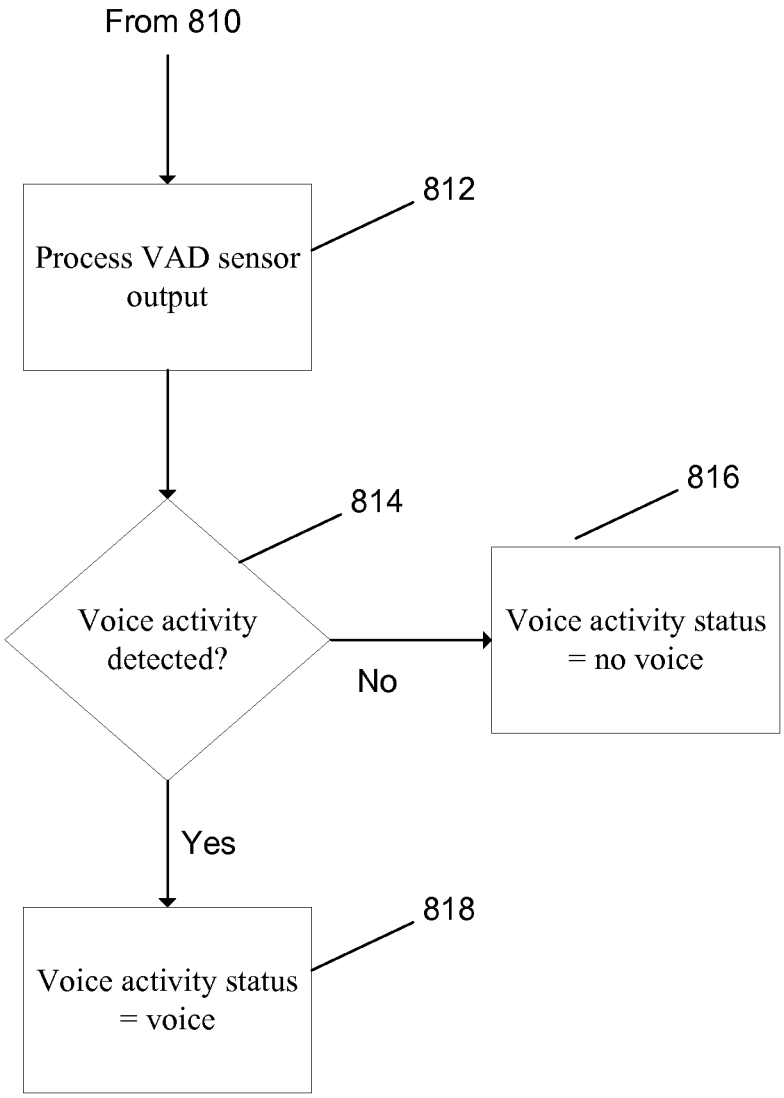

FIGS. 8A and 8B are a flowchart illustrating a voice activity detection process in an example. At block 802, an output signal from a capacitive sensor is received. At block 804, the capacitive sensor output signal is processed. At decision block 806, it is determined whether the capacitive sensor is touching the user's skin. If no at decision block 806, at block 808 a VAD sensor is disabled. If yes at decision block 806, at block 810 an output signal from the VAD sensor is received. At block 812, the VAD sensor output signal is processed. At decision block 814, it is determined whether voice activity is detected in the VAD sensor output signal. Alternatively, the output from the VAD sensor may be a binary voice or no voice signal. If no at decision block 814, at block 816 the voice activity status is updated to "no voice" status. If yes at decision block 814, at block 818 the voice activity status is updated to "voice" status. In the process described in FIGS. 8A and 8B, the voice activity detector sensor output signal is processed to determine a voice activity status only if the capacitive sensor output signal indicates that the capacitive sensor is in contact with the user skin.

In a further example, an acoustic microphone output signal is received, and the acoustic microphone output signal is processed to determine a voice activity status if the capacitive sensor output signal indicates no contact with the user skin. In this manner, an alternative method for determining voice activity is provided where the VAD sensor is not utilized.

In one example, the process further includes processing an acoustic microphone output signal in conjunction with the voice activity status to reduce noise in the acoustic microphone output signal. The voice activity status is used in a DSP voice processing algorithm to filter noise, where the noise filters are adapted based on whether speech is present or not at the microphone, and the voice activity status is utilized to optimize the signal-to-noise ratio.

Figure 9A:
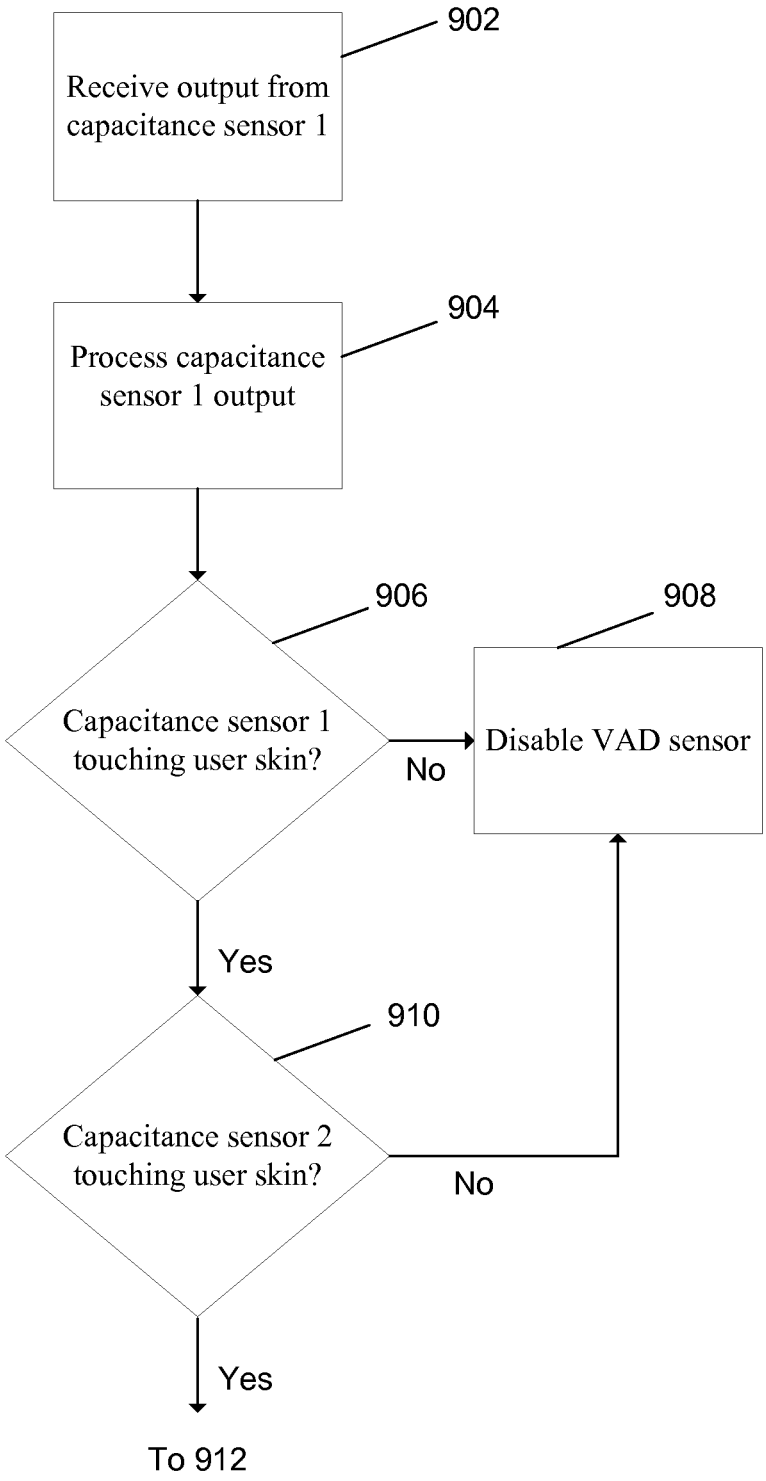
FIGS. 9A and 9B are a flowchart illustrating a voice activity detection process in a further example.
Figure 9B:
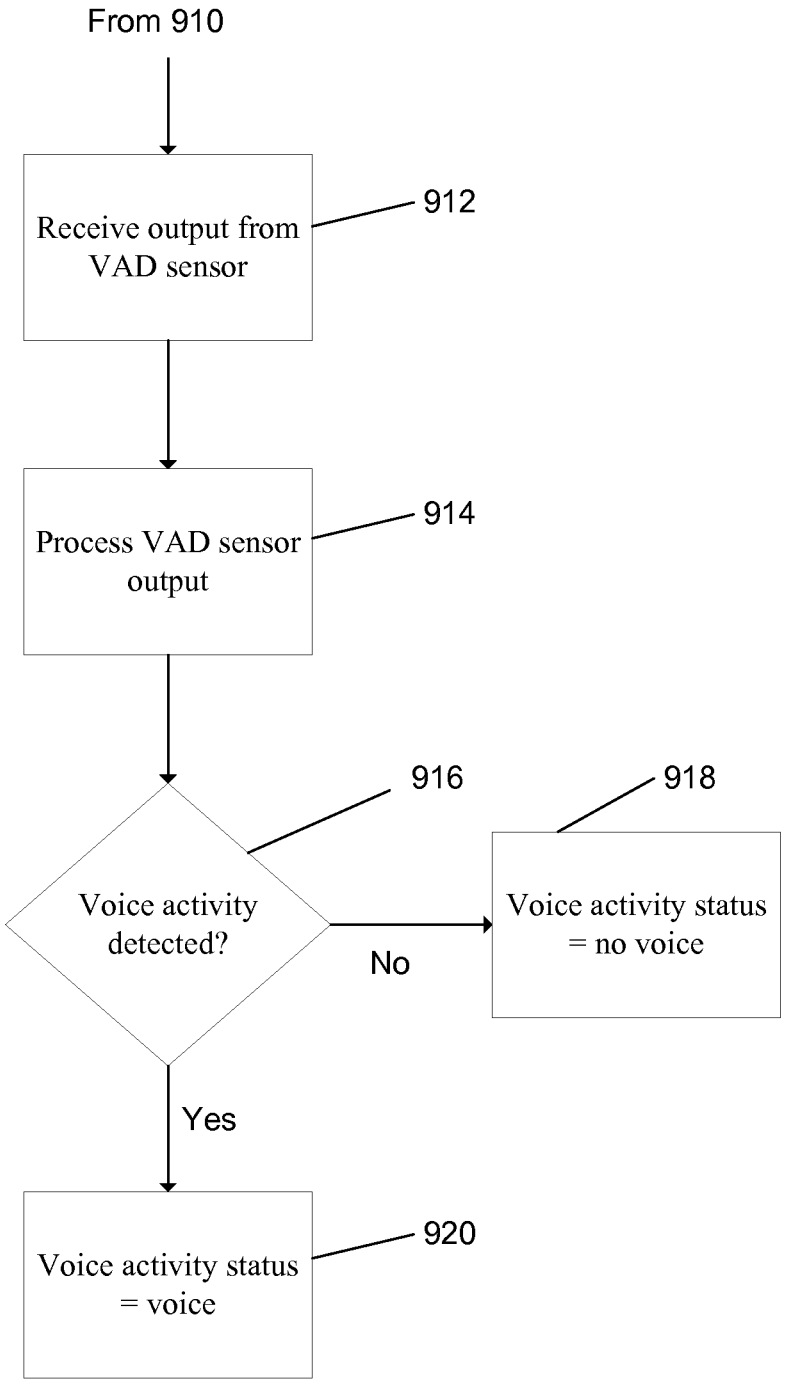

FIGS. 9A and 9B are a flowchart illustrating a voice activity detection process in a further example. At block 902, an output signal from a first capacitive sensor is received. At block 904, the first capacitive sensor output signal is processed. At decision block 906, it is determined whether the first capacitive sensor is touching the user's skin. If no at decision block 906, at block 908 a VAD sensor is disabled. An output signal from a second capacitive sensor is also received and processed. If yes at decision block 906, at decision block 910 it is determined whether a second capacitive sensor is touching the user's skin. If no at decision block 910, the process proceeds to block 908, and the VAD sensor is disabled.

If yes at decision block 910, at block 912 an output signal from the VAD sensor is received. At block 914, the VAD sensor output signal is processed. At decision block 916, it is determined whether voice activity is detected in the VAD sensor output signal. If no at decision block 916, at block 918 the voice activity status is updated to "no voice" status. If yes at decision block 916, at block 920 the voice activity status is updated to "voice" status. In the process described in FIGS. 9A. and 9B, the voice activity detector sensor output signal is processed to determine a voice activity status only if both the first capacitive sensor output signal and second capacitance output signal indicate contact with the user skin.

In one example, the process further includes processing an acoustic microphone output signal to determine a voice activity status if both or either of the first capacitive sensor output signal and second capacitive sensor output signal indicate no contact with the user skin. In this manner, an alternative method for determining voice activity is provided where the VAD sensor is not utilized.

Figure 10:
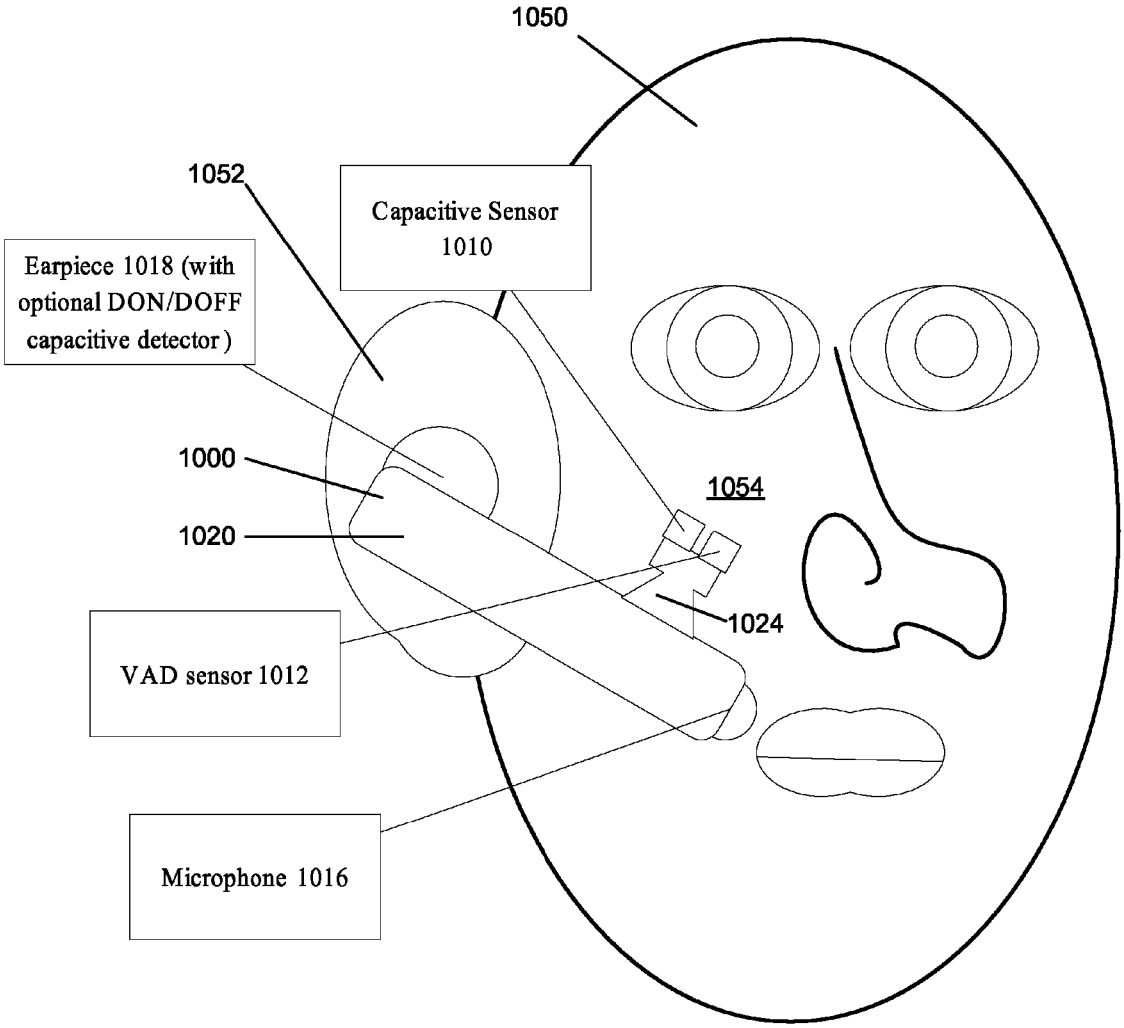
FIG. 10 is a diagram illustrating a headset application of a voice activity detection apparatus in one example.

FIG. 10 is a diagram illustrating a headset application of a voice activity detection apparatus in one example. A headset 1000 includes a capacitive sensor 1010, a voice activity detector sensor 1012, an acoustic microphone 1016, and an earpiece receiver 1018. The headset 1000 may also include an optional second capacitive sensor disposed on the earpiece. This second capacitive sensor may also function as a sensor for determining whether the headset is currently being worn or not worn. The headset 1000 includes a housing 1020 having an exterior surface on which the capacitive sensor 1010 and the voice activity detector sensor 1012 are disposed. In the example shown in FIG. 10, the housing 1020 includes an arm 1024 extending towards a user skin 1054 when the headset 1000 is worn by user 1050. Capacitive sensor 1010 and voice activity detector sensor 1012 are intended to contact user skin 1054 when the headset 1000 is worn.

In operation, the capacitive sensor 1010 detects whether it is in contact with the user skin. The voice activity detector sensor 1012 detects vibration of human tissue associated with user speech. The earpiece receiver 1018 outputs an audio signal, such as a speech signal received from a far end speaker. Acoustic microphone 1016 receives speech from user 1050 and outputs an acoustic microphone output signal for processing by the headset and, in one example, transmission to a far end listener. Operation of headset 1000, including that of capacitive sensor 1010 and voice activity detector sensor 1012, is described above in reference to FIG. 4, FIG. 6 and FIGS. 8A-8B.

In one example, headset 1000 utilizes the voice activity detection output of voice activity or no voice activity to reduce noise in an acoustic microphone output signal which is transmitted to a far end listener. Where voice activity detector sensor 1012 is not in proper contact with the user skin 1054, the acoustic microphone output signal is processed to determine the voice activity status.

The various examples described above are provided by way of illustration only and should not be construed to limit the invention. Based on the above discussion and illustrations, those skilled in the art will readily recognize that various modifications and changes may be made to the present invention without strictly following the exemplary embodiments and applications illustrated and described herein. For example, the methods and systems described herein may be applied to other body worn devices in addition to headsets. Furthermore, the functionality associated with any blocks described above may be centralized or distributed. It is also understood that one or more blocks of the headset may be performed by hardware, firmware or software, or some combinations thereof. Such modifications and changes do not depart from the true spirit and scope of the present invention that is set forth in the following claims.

While the exemplary embodiments of the present invention are described and illustrated herein, it will be appreciated that they are merely illustrative and that modifications can be made to these embodiments without departing from the spirit and scope of the invention. Thus, the scope of the invention is intended to be defined only in terms of the following claims as may be amended, with each claim being expressly incorporated into this Description of Specific Embodiments as an embodiment of the invention.

What is claimed is:

1. A head worn device comprising:

a capacitive sensor disposed at a head worn device configured to provide a capacitive sensor output signal, wherein the capacitive sensor is configured to detect whether the capacitive sensor is in contact with a user skin of a user head;

a voice activity detector sensor disposed at the head worn device arranged to contact a user skin of the user head, the voice activity detector sensor configured to provide a voice activity detector sensor output signal, wherein the voice activity detector sensor is configured to detect vibration of human tissue associated with user speech, and wherein the capacitive sensor is arranged adjacent to the voice activity detector sensor on a same surface of the head worn device such that the voice activity detector sensor is positioned to contact the user skin of the user head whenever the capacitive sensor is in contact with the user skin of the user head; and a processor configured to receive the capacitive sensor output signal and the voice activity detector sensor output signal, wherein the voice activity detector sensor output signal is processed to determine a voice activity status only if the capacitive sensor output signal indicates that the capacitive sensor is in contact with the user skin of the user head.

2. The head worn device of claim 1, wherein the voice activity detector sensor comprises a tissue vibration detector.

3. The head worn device of claim 1, wherein the voice activity detector sensor comprises one selected from the following group: a bone conduction microphone, an accelerometer, a tissue conduction microphone, and a capacitance sensor.

4. The head worn device of claim 1, further comprising an acoustic microphone providing an acoustic microphone output signal, wherein the acoustic microphone detects acoustic air waves associated with user speech, and wherein the acoustic microphone output signal is processed to determine a voice activity status.

5. The head worn device voice of claim 4, wherein the acoustic microphone output signal is processed to determine a voice activity status only if the capacitive sensor output signal indicates that the capacitive sensor is not in contact with the user skin.

6. The head worn device of claim 1, further comprising a housing having an exterior surface on which the capacitive sensor and the voice activity detector sensor are disposed adjacent to each other on a same planar surface.

7. A head worn device comprising:

a first capacitive sensor disposed at a head worn device configured to provide a first capacitive sensor output signal, wherein the first capacitive sensor is configured to detect whether the first capacitive sensor is in contact with a user skin of a user head;

a second capacitive sensor disposed at the head worn device configured to provide a second capacitive sensor output signal, wherein the second capacitive sensor is configured to detect whether the second capacitive sensor is in contact with a user skin of a user head;

a voice activity detector sensor disposed at the head worn device arranged to contact a user skin of the user head, the voice activity detector sensor configured to provide a voice activity detector sensor output signal, wherein the voice activity detector sensor is configured to detect vibration of human tissue associated with user speech, and wherein the first capacitive sensor and the second capacitive sensor are arranged adjacent to and on opposite sides of the voice activity detector sensor on a same surface of the head worn device such that the voice activity detector sensor is positioned to contact the user skin of the user head whenever both the first capacitive sensor and the second capacitive sensor are in contact with the user skin of the user head;

a processor configured to receive the first capacitive sensor output signal, the second capacitive sensor output signal and the voice activity detector sensor output signal, wherein the voice activity detector sensor output signal is processed to determine a voice activity status only if both the first capacitive sensor output signal indicates that the first capacitive sensor is in contact with the user skin of the user head and the second capacitive sensor output signal indicates that the second capacitive sensor is in contact with the user skin of the user head.

8. The head worn device of claim 7, wherein the voice activity detector sensor comprises a tissue vibration detector.

9. The head worn device of claim 7, wherein the voice activity detector sensor comprises one selected from the following group: a bone conduction microphone, an accelerometer, a tissue conduction microphone, and a capacitance sensor.

10. The head worn device of claim 7, further comprising a housing having an exterior surface on which the first capacitive sensor, the second capacitive sensor, and the voice activity detector sensor are disposed on a same planar surface, wherein the first capacitive sensor and the second capacitive sensor are disposed on opposite sides of the voice activity detector sensor.

11. The head worn device of claim 10, wherein the first capacitive sensor and the second capacitive sensor are adjacent to the voice activity detector sensor.

12. The head worn device of claim 7, further comprising:

a housing having an exterior surface on which the first capacitive sensor, the second capacitive sensor, and the voice activity detector sensor are disposed;

a receiver for outputting an audio signal, wherein the first capacitive sensor is located in close proximity to the receiver and the second capacitive sensor is located in close proximity to the voice activity detector sensor.

13. The head worn device of claim 7, further comprising:

a third capacitive sensor providing a third capacitive sensor output signal that is output to the processor, wherein the third capacitive sensor detects whether the third capacitive sensor is in contact with a user skin.

14. The head worn device of claim 13, further comprising a housing having an exterior surface on which the first capacitive sensor, the second capacitive sensor, the third capacitive sensor, and the voice activity detector sensor are disposed, wherein the first capacitive sensor, second capacitive sensor, and third capacitive sensor are disposed in a circular pattern around the voice activity detector sensor.

15. A head worn device comprising:

a skin contact sensing means disposed at a head worn device for determining contact with a user skin of a user head;

a tissue vibration sensing means disposed at the head worn device for detecting vibration of human tissue associated with user speech, the tissue vibration sensing means arranged to contact a user skin of the user head, wherein the skin contact sensing means is arranged adjacent to the tissue vibration sensing means on a same surface of the head worn device such that the tissue vibration sensing means is positioned to contact the user skin of the user head whenever the skin contact sensing means is in contact with the user skin of the user head; and a processing means for processing an output of the tissue vibration sensing means to determine a voice activity status only if the skin contact sensing means is in contact with the user skin of the user head.

16. The head worn device of claim 15, further comprising a housing means for disposing the skin contact sensing means on and the tissue vibration sensing means on, wherein the tissue vibration sensing means is disposed adjacent the skin contact sensing means.

* * * * *